US007637246B2

(12) United States Patent
Viele

(10) Patent No.: US 7,637,246 B2
(45) Date of Patent: Dec. 29, 2009

(54) COMPENSATING FOR VARYING FUEL AND AIR PROPERTIES IN AN ION SIGNAL

(75) Inventor: Matthew Viele, Fort Collins, CO (US)

(73) Assignee: Woodward Governor Company, Fort Collins, CO (US)

( * ) Notice: Subject to any disclaimer, the term of this patent is extended or adjusted under 35 U.S.C. 154(b) by 115 days.

(21) Appl. No.: 11/469,998

(22) Filed: Sep. 5, 2006

(65) Prior Publication Data

US 2008/0053406 A1 Mar. 6, 2008

(51) Int. Cl.
*F02D 41/14* (2006.01)

(52) U.S. Cl. ..... 123/406.142

(58) Field of Classification Search ..... 123/406.14, 123/406.16, 406.24–406.39, 479, 494, 536
See application file for complete search history.

(56) References Cited

U.S. PATENT DOCUMENTS 6,742,499 B2 * 6/2004 Viele et al. ..... 123/406.14
6,786,200 B2 * 9/2004 Viele et al. ..... 123/406.27
6,832,472 B2 * 12/2004 Huang et al. ..... 60/285
2004/0084025 A1 * 5/2004 Zhu et al. ..... 123/435

* cited by examiner

*Primary Examiner*—M. McMahon
(74) *Attorney, Agent, or Firm*—Reinhart Boerner Van Deuren P.C.

(57) ABSTRACT

Presented is a device that provides a correction factor to compensate for varying fuel and air properties in an ion signal sensed in combustion chamber of reciprocating and continuous combustion engines, on a predetermined basis during the combustion of conventional petroleum-based fuels, other alternate fuels, and renewable fuels. The device uses an ion current reference sensor device and a processing module to provide a correction factor to the ion signal(s). The ion current reference sensor device is positioned near the chamber(s) of the engine and fuel provided to the chamber(s) is routed to provide a diffusion flame and the resultant ion current from the flame is measured and provided to the processing module at discrete intervals during the combustion process. Alternatively, a pre-mixed flame is used. The processing module provides a scaling factor to be applied to the ion signal and/or calibration points used to detect combustion conditions.

20 Claims, 5 Drawing Sheets

COMPENSATING FOR VARYING FUEL AND AIR PROPERTIES IN AN ION SIGNAL

BACKGROUND

Ion signals are used in a variety of controls for various types of engines in various industries such as light and heavy duty vehicles, locomotives, off-highway equipment, marine vessels and many industrial applications. For example, ion current has been used to detect knock and misfire in lean burn engines, to detect combustion instability in continuous combustion systems, to determine $NO_x$ emissions, to control exhaust gas recirculation, etc.

An ion signal varies due to many factors, including A/F (air/fuel) ratio, flame proximity, humidity, and fuel properties. For example, the important fuel properties that affect ion current (and the combustion process) include hydrogen to carbon ratio, distillation range, volatility and cetane number. Variations in the design parameters from one engine to another and in the fuel properties affect the cylinder gas temperature and pressure, mixture formation, and the distribution of the equivalence ratio in the combustion chamber, all of which affect the formation of ions. The ion signal can be thought of as a single equation with many unknowns. While many of the unknowns have a small effect on the ion signal, they can be enough to reduce the effectiveness of the controls.

One example of the ion signal variation is shown in FIGS. 7*a* and 7*b*. Under the same conditions, the ion signal (labeled with reference numeral 700) exhibits a smaller or larger "second hump" depending on the fuel type. FIG. 7*a* shows an incipient knock event where the fuel type is pure natural gas. FIG. 7*b* shows an incipient knock event where the fuel type is a natural gas and propane mixture with other factors remaining the same. It can be seen that the ion signal variation resulting from a different fuel type is of the same order of magnitude as an incipient knock signal. As a result, the knock detection control isn't as effective with some fuels and could lead to erroneous detections.

BRIEF SUMMARY

Described herein is, among other things, a method and apparatus to compensate for varying fuel and air properties in an operating environment that detects and uses an ion current signal that changes as a result of the variation in the fuel and air properties. The method and apparatus account for the properties of varying fuel and air without requiring a complete analysis or understanding of the components influencing the ion current signal. Additionally, the method and apparatus does not require knowledge of the exact composition of the fuel or humidity.

The method and apparatus receive a reference ion current signal indicating a concentration of ions in a reference combustion chamber. A determination is made of whether the reference ion current signal has changed from a prior reference ion current signal. If the reference ion current signal has changed, a scaling factor is determined and transmitted to at least one controller that receives the ion current signal. The controller scales the ion current signal by the scaling factor. Alternatively, the controller scales at least one calibration point used in the controller to determine combustion conditions.

The scaling factor is periodically updated by receiving the sample of the reference ion current signal periodically. The scaling factor can be linear or non-linear. For example, it can be proportional to a square of a ratio of the reference ion current signal over the prior reference ion current signal, proportional to a natural logarithm of a ratio of the reference ion current signal over the prior reference ion current signal, etc.

The apparatus includes means for producing the reference ion current signal, means for receiving a reference ion current signal indicating a concentration of ions in the reference combustion chamber and processing means for determining if the reference ion current signal has changed from a prior reference ion current signal, for determining a scaling factor if the reference ion current signal has changed from a prior reference ion current signal and for transmitting the scaling factor to a controller that receives the ion current signal.

In one embodiment, the means for producing the reference ion current signal comprises an ion sensor located near a reference burner located in the reference combustion chamber where the reference burner is adapted to burn fuel and air. The ion sensor location is at a position such that the ion sensor can detect ions from flame produced by the reference burner.

Additional features and advantages will be made apparent from the following detailed description of illustrative embodiments, which proceeds with reference to the accompanying figures.

BRIEF DESCRIPTION OF THE DRAWINGS

The accompanying drawings incorporated in and forming a part of the specification illustrate several aspects of the technologies described herein, and together with the description serve to explain the principles of the technologies. In the drawings.

While the techniques will be described in connection with certain embodiments, there is no intent to limit it to those embodiments. On the contrary, the intent is to cover all alternatives, modifications and equivalents as included within the spirit and scope of the invention as defined by the appended claims.

DETAILED DESCRIPTION

The apparatus and method described herein compensates for varying fuel and air properties in an ion signal without requiring complete analysis or understanding of the components influencing the ion signal.

Figure 1:
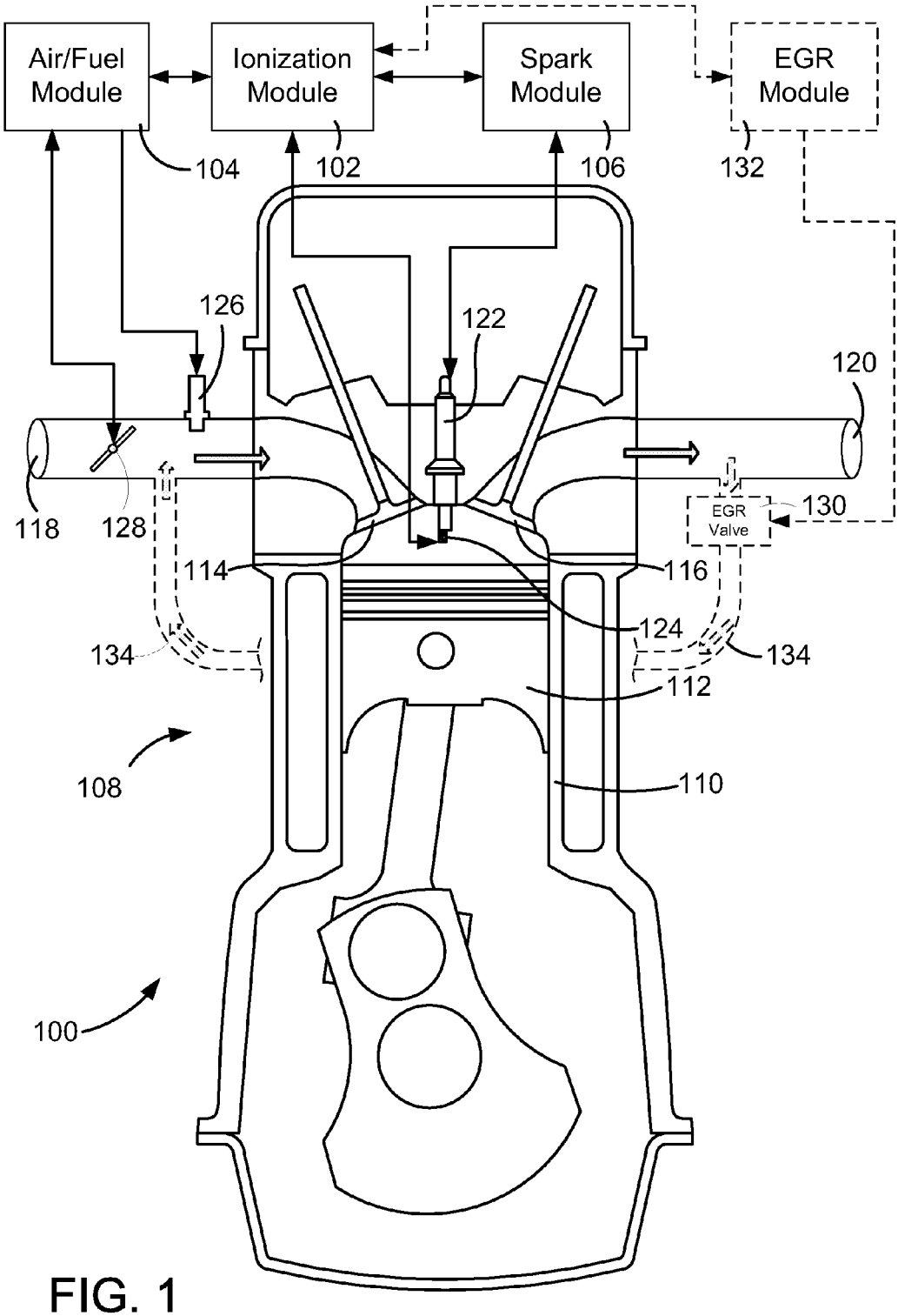
FIG. 1 is a schematic view of a representative environment in which the technologies may operate.

Turning to the drawings, wherein like reference numerals refer to like elements, a suitable combustion engine environment in which the apparatus may operate in is shown in FIG. 1. The environment 100 includes an ionization module 102, an air/fuel module 104, a spark module 106, and a reciprocating engine 108. While a reciprocating engine 108 is shown, the apparatus may be used in other environments such as, for example, continuous combustion engines such as turbine engines. While the ionization module 102, the air/fuel module 104, the spark module 106 are shown separately, it is recognized that the modules 102, 104, 106, may be combined into a single module or be part of an engine controller having other inputs and outputs. The reciprocating engine includes engine cylinder 110, a piston 112, an intake valve 114 and an exhaust valve 116. An intake manifold 118 is in communication with the cylinder 110 through the intake valve 114. An exhaust manifold 120 receives exhaust gases from the cylinder 110 via the exhaust valve 116. The intake valve 114 and exhaust valve 116 may be electronically, mechanically, hydraulically, or pneumatically controlled or controlled via a camshaft. A spark plug 122 with a spark gap 124 ignites the air/fuel mixture in cylinder 110. Spark module 106 controls ignition timing and provides power to the spark plug 122.

In one embodiment, the exhaust manifold 120 is in fluid communication with EGR valve 130. The EGR valve 130, controlled by EGR module 132, provides exhaust gas to the intake manifold 118, preferably downstream of the throttle valve 128 for EGR control of the reciprocating engine 108. For simplicity, the recirculation path from the EGR valve 130 to the intake is designated by arrows 134. In some systems, the exhaust gas may be further cooled by means of a cooler in the exhaust gas recirculation path. Additionally, the exhaust valve 114 can be controlled with variable timing to assist in keeping some of the exhaust gas in the cylinder 108. The air/fuel module 104 controls fuel injector 126 and may control throttle valve 128 to deliver air and fuel, at a desired ratio, to the engine cylinder 110. The air/fuel module 104 receives feedback from the ionization module and adjusts the air/fuel ratio. The EGR module 132 used in some applications controls the amount of exhaust gas recirculated into the intake manifold and therefore into the cylinder.

Figure 2:
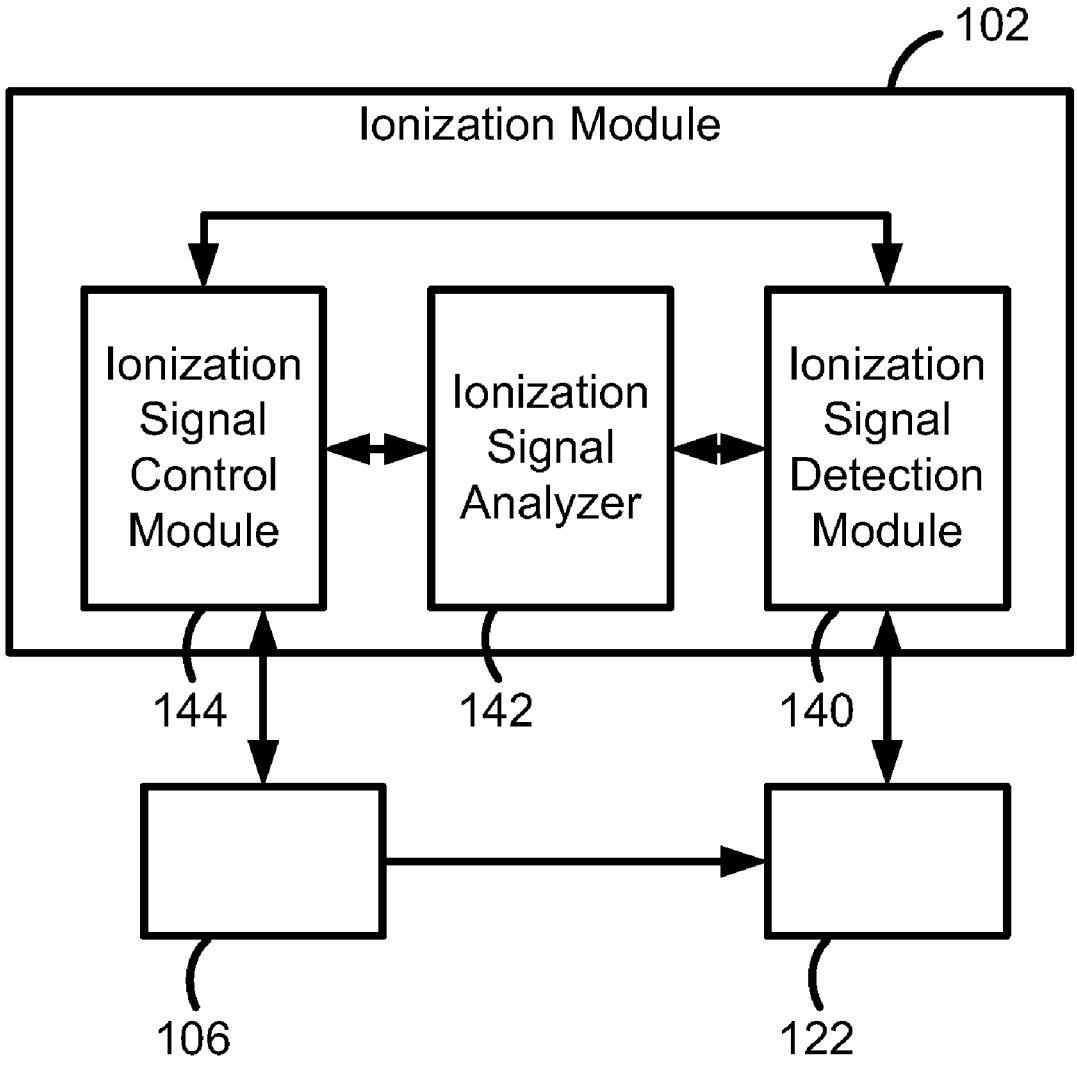
FIG. 2 is a block diagram view of an ionization module that interacts with the technologies described herein.

The ionization module contains circuitry for detecting and analyzing the ionization signal. In the illustrated embodiment, as shown in FIG. 2, the ionization module includes an ionization signal detection module 140, an ionization signal analyzer 142, and an ionization signal control module 144. In order to detect combustion conditions, the ionization module 102 supplies power to the spark gap 124 after the air and fuel mixture is ignited and measures ion current signals from the spark gap 124 via ionization signal detection module 140. Alternatively a conventional ionization probe or other conventional device to detect ionization may be used to measure the ionization signals. Ionization signal analyzer 142 receives the ion current signal from ionization signal detection module 140 and determines if an abnormal combustion condition exists. The ionization signal control module 144 controls ionization signal analyzer 142 and ionization signal detection module 140. The ionization signal control module 144 provides an indication to the air/fuel module 104, spark module 106, and EGR module 130 of combustion conditions. In one embodiment, the ionization module 102 sends the indication to other modules in the engine system such as an engine controller 146. While the ionization signal detection module 140, the ionization signal analyzer 142, and the ionization signal control module 144 are shown separately, it is recognized that they may be combined into a single module and/or be part of an engine controller having other inputs and outputs.

Figure 3:
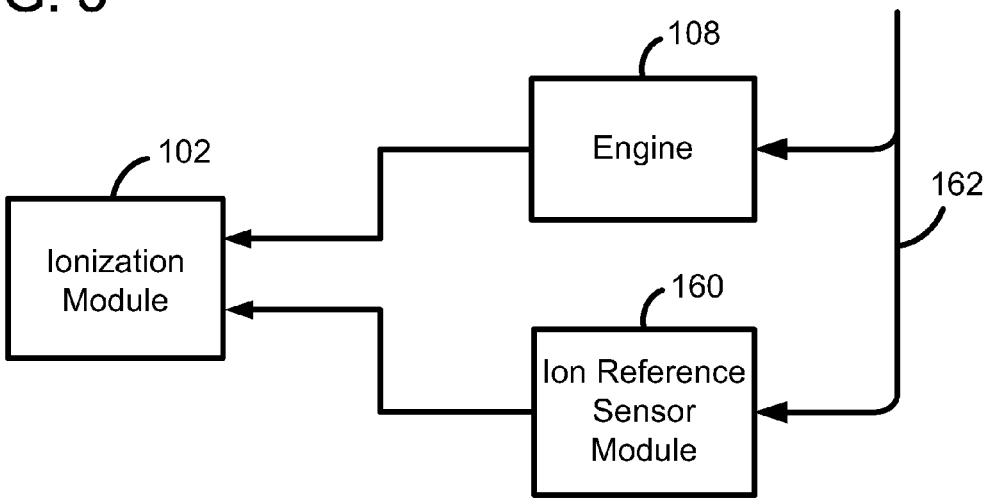
FIG. 3 is a block diagram view of an embodiment of the technologies in the environment of FIG. 1.
Figure 4:
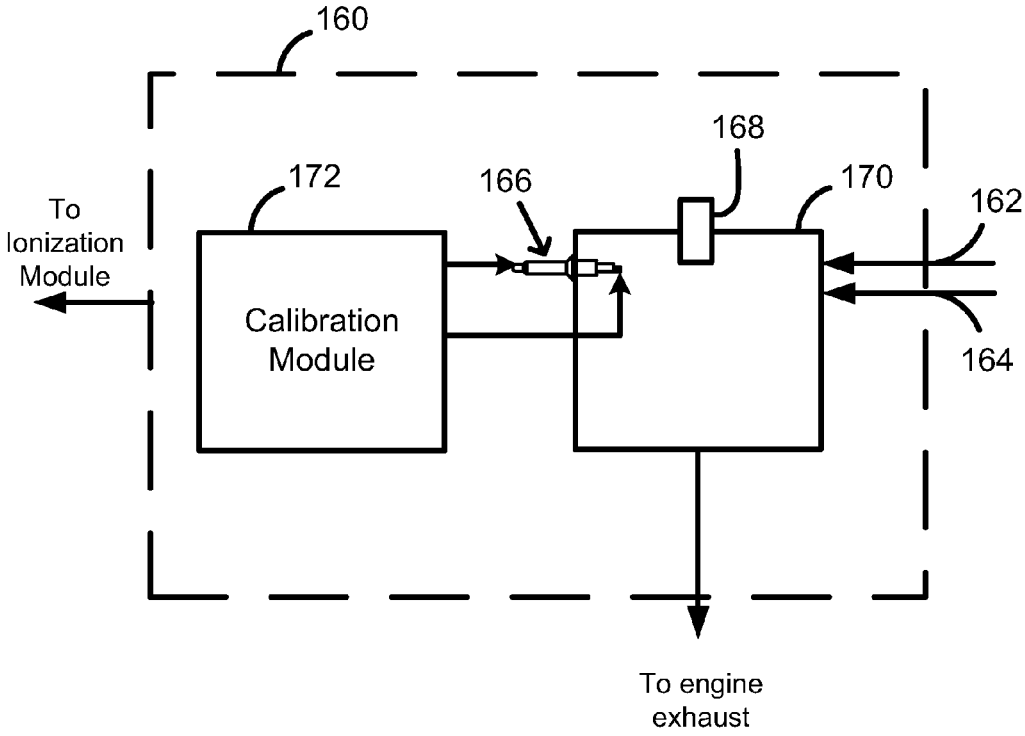
FIG. 4 is a block diagram view of an embodiment of the ion reference sensor module of FIG. 3.

Turning now to FIGS. 3 and 4, the apparatus shall be described in the reciprocating engine environment 100 described above. The apparatus may be used in other environments such as, for example, continuous combustion engines such as turbine engines and compression ignition engines. The apparatus provides an ion reference sensor module 160 that is positioned near the engine environment and receives fuel from the fuel line 162 that provides fuel to the fuel injectors 126 in reciprocating engine 108 and air from air line 164. Alternatively, the air and fuel is pre-mixed and provided to the ion reference sensor module 160. The ion reference sensor module 160 contains an ion sensor 166 that detects the concentration of ions produced by a flame burning at reference burner 168 in a reference combustion chamber 170 and a calibration module 172. While FIG. 4 shows a spark plug as an ion sensor, other types of ion sensors may be used. The flame should be as small as possible, similar to a pilot flame. In the description that follows, this flame shall be referred to as a pilot flame in describing the method. Note that the calibration module 172 may be part of ionization module 102 or part of other controllers such as an engine control unit (ECU). The reference burner 168 is mounted in the operating environment and uses the same fuel and air that is being consumed by the engine. Note that if EGR module 132 is used and the engine is operating with a high EGR rate (e.g., >20%), the air sample for the reference burner should be taken after the EGR is mixed in with the intake so that the combustion uses air with the same characteristics used in the is not different than the air used in the engine combustion chamber (e.g., engine cylinder 110). The air/fuel ratio and quantity of gas provided to the reference combustion chamber 170 and burned by the reference burner 168 is controlled so that it is not changing. The air/fuel ratio (and quantity of gas) may be regulated opened-loop or closed-loop. The exhaust products are "dumped" upstream of any exhaust after-treatment of the engine 108 to reduce overall pollution from the engine 108.

Figure 5:
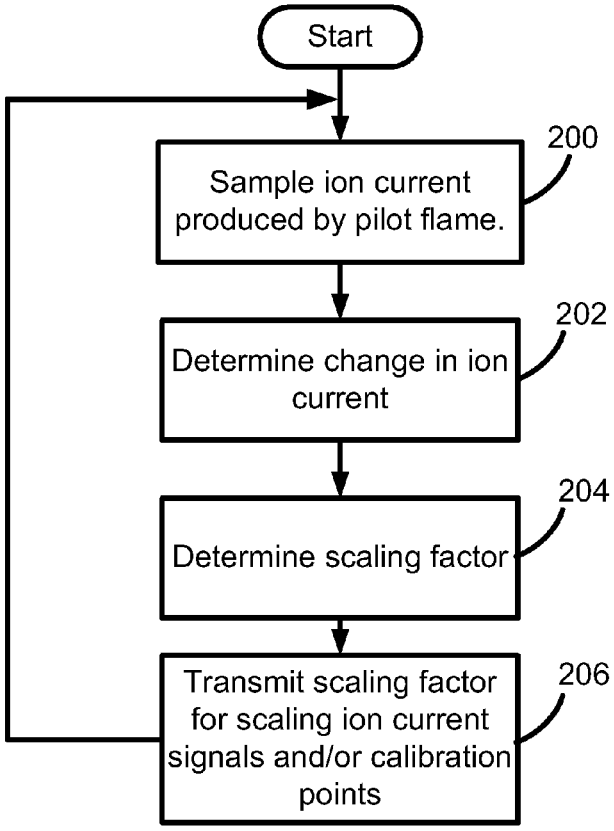
FIG. 5 is a flowchart illustrating the steps of compensating for varying fuel and air properties.

Turning now to FIG. 5, the reference burner 168 burns the flame consistently. The calibration module 172 periodically samples the reference ion current signal from ion sensor 166 indicating the concentration of ions in reference combustion chamber 170 (step 200). The ion current signal should be sampled as fast as the fuel mixture is expected to change. For example, in one embodiment the ion current signal is sampled at a 5 Hz rate for engines operating in landfill type applications while in other applications, the reference ion current signal is sampled between 10 Hz and 0.01 Hz, depending on the application. The reference ion current will increase or decrease with the composition of the fuel burned, the humidity of the air consumed, etc.

The calibration module 172 has processing means that determines how the reference ion current signal has changed (step 202). The calibration module 172 typically includes a variety of computer readable media. Computer readable media can be any available media that can be accessed by the components 102 and includes both volatile and nonvolatile media, removable and non-removable media. A scaling factor is determined based upon how the reference ion current signal has changed (step 204). The scaling factor is transmitted to the ionization module 102 (step 206). The transmission is likely to be over a network interface, such as for example, a Control Area Network (CAN) interface that is common in many engine applications. The scaling factor is a value that is used to scale ion current signals from spark gap 124 to compensate for a change in humidity, fuel property, etc. without knowledge of the change(s) and may also be used to scale calibration points used to detect abnormal engine conditions. Steps 200 to 206 are repeated during engine operation.

Figure 6:
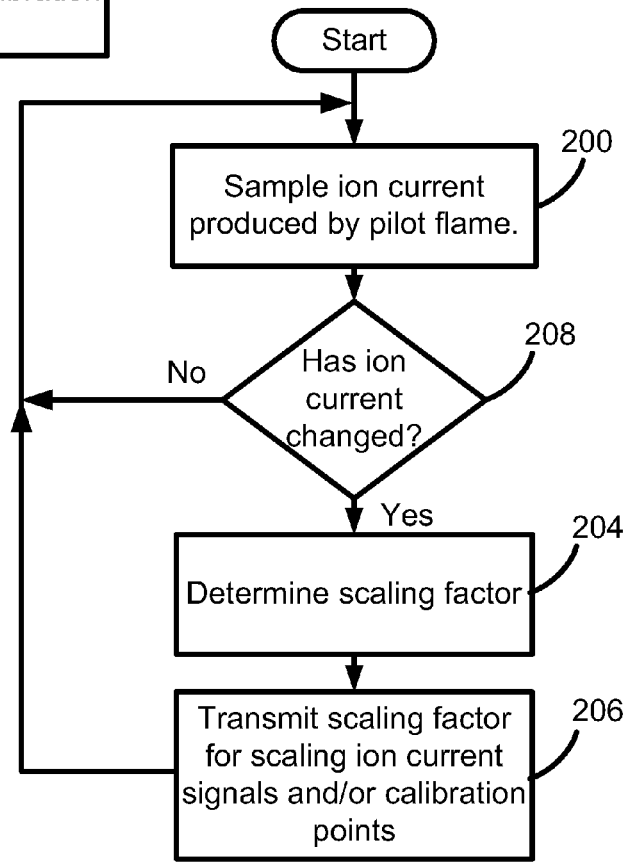
FIG. 6 is a flowchart illustrating an alternate embodiment of the steps of compensating for varying fuel and air properties.
Figure 7A:
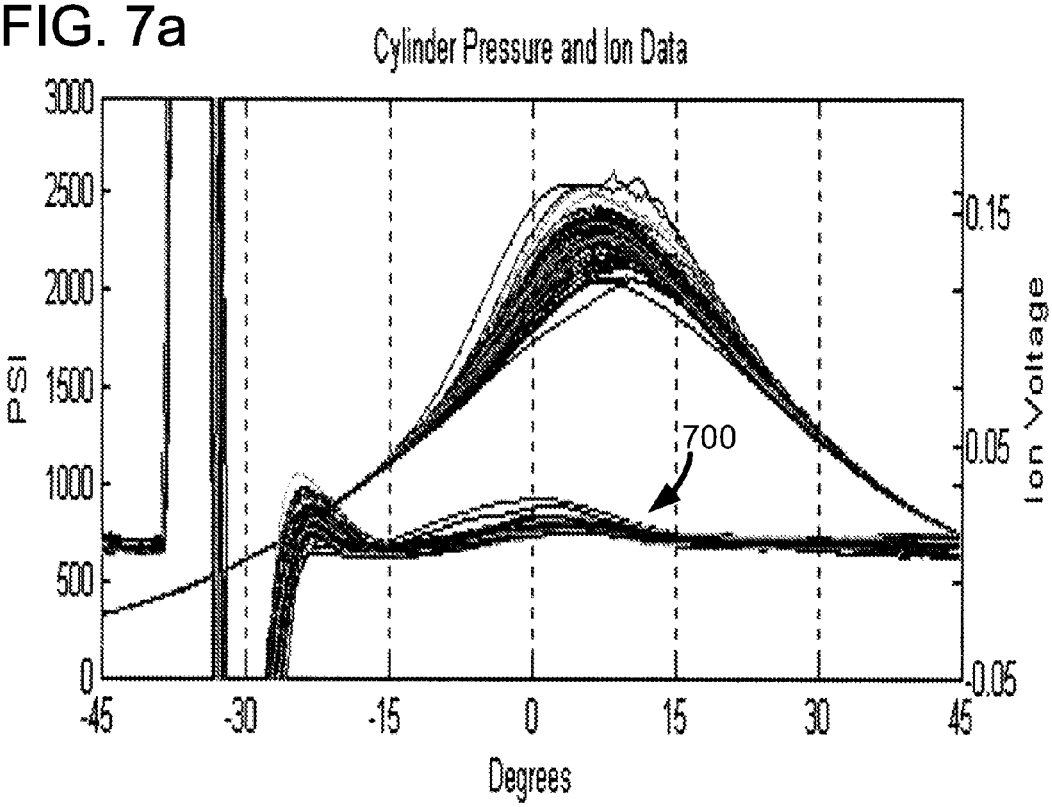
FIGS. 7*a* and 7*b* are graphs illustrating how the ion signal and cylinder pressure vary with a different mixture of fuel.
Figure 7B:
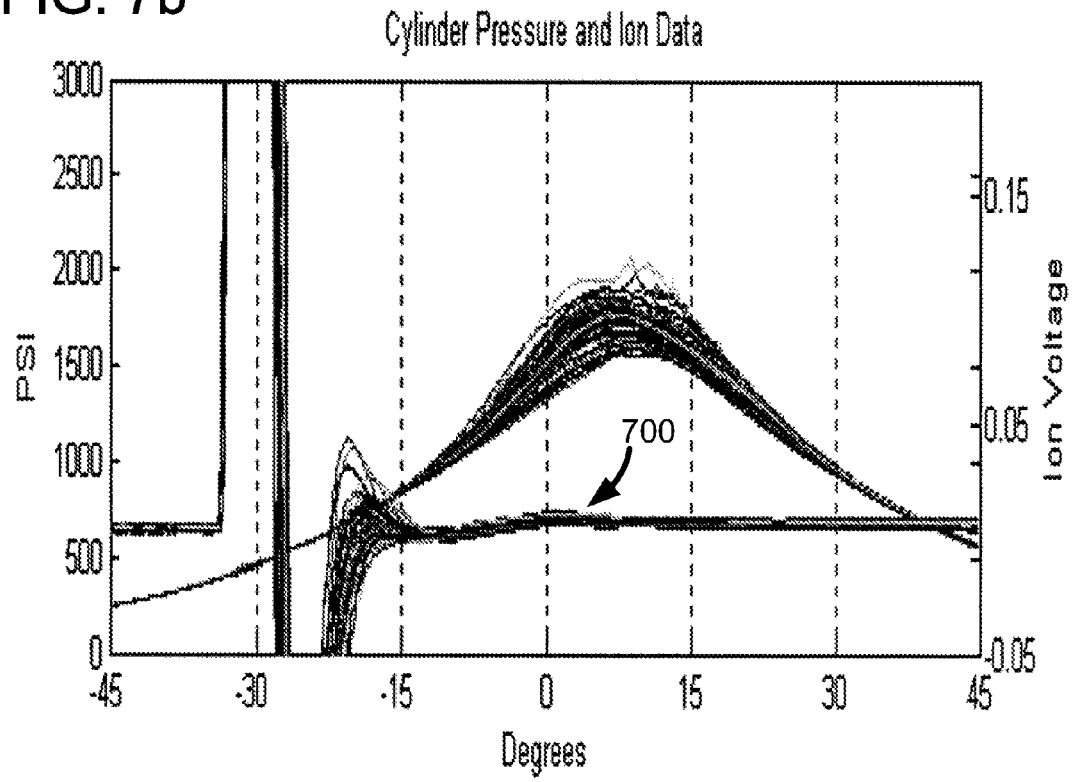

Turning now to FIG. 6, in an alternate embodiment, the processing means determines if the difference in the reference current ion signal is outside a predetermined threshold (step 208). If the difference in the reference current ion signal is not outside the predetermined threshold, the scaling factor is set to be the existing value and steps 202 and 208 are repeated. If the reference current ion signal is outside the threshold, the scaling factor is determined (step 204) and transmitted to the ionization module 102 (step 206). Steps 200, 204, 206, and 208 are repeated, The scaling factor can be linear or non-linear. For example, the scaling factor could be the ratio of the most recent reference ion current signal to the previous reference ion current signal, the square of the ratio of the most recent reference ion current signal to the previous reference ion current signal, the natural log of the ratio of the most recent reference ion current signal to the previous reference ion current signal, etc.

From the foregoing, it can be seen that the apparatus and method allows a direct correction of the ion current signal via the scaling factor because it is measured in the same manner as the in-cylinder/combustor ion current signals. The scaling factor accounts for all of the properties of varying fuel and air without requiring complete analysis or understanding of the components influencing the ion current signal.

The use of the terms "a" and "an" and "the" and similar referents in the context of describing the technologies (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of compensating an ion current signal sensed in an engine combustion chamber to correct for variations in the ion current signal resulting from variations in fuel and air properties in the combustion chamber, comprising the steps of:

receiving a first reference ion current signal indicating a first concentration of ions in a reference combustion chamber;

receiving a second reference ion current signal indicating a second concentration of ions in the reference combustion chamber;

determining a difference between the second reference ion current signal and the first reference ion current signal;

determining a scaling factor based on the difference between the second reference ion current signal and the first reference ion current signal;

scaling the ion current signal by the scaling factor to form a compensated ion current signal; and controlling the engine based on the compensated ion current signal.

2. The method of claim 1 further comprising the steps of scaling at least one calibration point used to detect abnormal engine conditions using the scaling factor to form at least one compensated calibration point, and detecting abnormal engine conditions based on the at least one compensated calibration point.

3. The method of claim 1 wherein the steps of receiving, determining, and scaling are performed periodically so that the step of controlling is periodically adjusted for possible changes in fuel and air properties in the combustion chamber.

4. The method of claim 1 wherein the step of determining the scaling factor comprises determining the scaling factor based on a ratio of the second reference ion current signal to the first reference ion current signal.

5. The method of claim 1 wherein the step of determining the scaling factor comprises the step of determining a linear scaling factor.

6. The method of claim 1 wherein the step of determining the scaling factor comprises the step of determining a scaling factor that is proportional to a square of a ratio of the second reference ion current signal over the first reference ion current signal.

7. The method of claim 1 wherein the step of determining the scaling factor comprises the step of determining a scaling factor that is proportional to a natural logarithm of a ratio of the second reference ion current signal over the first reference ion current signal.

8. The method of claim 1 further comprising the step of supplying to the reference combustion chamber fuel and air from the same sources supplying the engine combustion chamber.

9. A computer-readable medium having computer executable instructions for performing the steps of claim 1.

10. The computer-readable medium of claim 9 having further computer-executable instructions for performing the steps of scaling at least one calibration point used to detect abnormal engine conditions using the scaling factor to form at least one compensated calibration point, and detecting abnormal engine conditions based on the at least one compensated calibration point.

11. The computer-readable medium of claim 9 having further computer-executable instructions for performing the steps of receiving, determining and scaling periodically.

12. The computer-readable medium of claim 9 wherein the step of determining the scaling factor comprises determining the scaling factor based on a ratio of the second reference ion current signal to the first reference ion current signal.

13. The computer-readable medium of claim 9 wherein the step of determining the scaling factor comprises the step of determining a linear scaling factor.

14. The computer-readable medium of claim 9 wherein the step of determining the scaling factor comprises the step of determining a scaling factor that is proportional to a square of a ratio of the second reference ion current signal over the first reference ion current signal.

15. The computer-readable medium of claim 9 wherein the step of determining the scaling factor comprises the step of determining a scaling factor that is proportional to a natural logarithm of a ratio of the second reference ion current signal over the first reference ion current signal.

16. The computer-readable medium of claim 9 having further computer-executable instructions for performing the step comprising supplying to the reference combustion chamber fuel and air from the same sources supplying the engine combustion chamber.

17. An apparatus for compensating an ion current signal sensed in an engine combustion chamber to correct for variations in the ion current signal resulting from variations in fuel or air properties in the engine combustion chamber, comprising:

means for receiving a reference ion current signal indicating a concentration of ions in a reference combustion chamber being supplied with fuel and air from same sources of fuel and air that are supplying the engine combustion chamber;

processing means for detecting a variation in the reference ion current signal resulting from a change in fuel or air properties and for determining a scaling factor based on the variation in the reference ion current signal;

means for scaling the ion current signal by the scaling factor to form a compensated ion current signal; and means for controlling the engine based on the compensated ion current signal.

18. The apparatus of claim 17 further comprising means for producing the reference ion current signal.

19. The apparatus of claim 18 wherein the means for producing the reference ion current signal comprises a reference burner located in the reference combustion chamber, the reference burner adapted to burn fuel and air.

20. The apparatus of claim 17 wherein the means for receiving the reference ion current signal comprises an ion sensor located in the reference combustion chamber at a position such that the ion sensor can detect ions from flame produced by the reference burner.

* * * * *

UNITED STATES PATENT AND TRADEMARK OFFICE

CERTIFICATE OF CORRECTION

PATENT NO. : 7,637,246 B2
APPLICATION NO. : 11/469998
DATED : December 29, 2009
INVENTOR(S) : Matthew Viele It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

Signed and Sealed this

Ninth Day of November, 2010

David J. Kappos

David J. Kappos
*Director of the United States Patent and Trademark Office*